US010391374B1

(12) United States Patent
Toronto

(10) Patent No.: US 10,391,374 B1
(45) Date of Patent: Aug. 27, 2019

(54) ELONGATED HAND THROWN PROJECTILE

(71) Applicant: Brian Toronto, Annapolis, MD (US)

(72) Inventor: Brian Toronto, Annapolis, MD (US)

( * ) Notice: Subject to any disclaimer, the term of this patent is extended or adjusted under 35 U.S.C. 154(b) by 0 days.

(21) Appl. No.: 15/906,004

(22) Filed: Feb. 27, 2018

(51) Int. Cl.

| | |
|---|---|
| ***A63B 43/02*** | (2006.01) |
| ***A63B 69/00*** | (2006.01) |
| ***A63B 43/00*** | (2006.01) |
| *A63B 43/06* | (2006.01) |

(52) U.S. Cl.
CPC ..... *A63B 69/0002* (2013.01); *A63B 43/002* (2013.01); *A63B 43/004* (2013.01); *A63B 43/06* (2013.01); *A63B 2069/0006* (2013.01); *A63B 2207/00* (2013.01); *A63B 2225/01* (2013.01); *A63B 2225/50* (2013.01)

(58) Field of Classification Search
CPC . A63B 43/002; A63B 43/004; A63B 2225/01; A63B 2069/0006; A63B 69/0002; A63H 7/00; A63H 27/00; A63H 33/18
USPC ..... 473/613, 592; 446/61, 63, 68, 66
See application file for complete search history.

(56) References Cited

U.S. PATENT DOCUMENTS 1,446,110 A * 2/1923 Williams ..... A63H 27/00 244/91
4,266,781 A * 5/1981 Blue ..... A63F 9/0278 473/575
4,887,822 A * 12/1989 Tsai ..... F42B 6/003 473/585
4,946,172 A * 8/1990 Wong ..... F42B 6/003 473/585
5,046,979 A * 9/1991 Ragan ..... A63H 27/02 244/54
5,112,062 A * 5/1992 Pratt ..... F42B 6/003 473/585
5,344,158 A * 9/1994 Gridley ..... F41B 15/00 30/298
5,860,879 A * 1/1999 Gable ..... A63B 67/183 473/575
6,010,419 A * 1/2000 Rappaport ..... A63B 43/002 473/613
6,042,494 A * 3/2000 Rappaport ..... A63B 43/002 473/613
6,056,616 A * 5/2000 Bushman ..... A63H 27/00 446/61
6,120,398 A * 9/2000 Myers ..... A63B 43/00 473/613
6,695,728 B1 * 2/2004 Eddins ..... A63B 43/002 473/613

(Continued)

*Primary Examiner* — Steven B Wong
(74) *Attorney, Agent, or Firm* — Laubscher & Laubscher P.C

(57) ABSTRACT

An elongated hand thrown projectile comprises a projectile body having a forward end and a rearward end with a projectile axis extending between the forward end and the rearward end. A finger grip having a longitudinal grip axis is attached to the projectile body. In an exemplary embodiment, a thumb grip comprising a planar portion is attached to the projectile body at a position longitudinally between the projectile forward end and the finger grip. The thumb grip and the finger grip are separated by a distance such that the thumb and finger of a single hand can simultaneously grip the thumb grip and finger grip. The elongated hand thrown projectile assists a pitcher in learning to throw with a linear, single-plane motion.

15 Claims, 3 Drawing Sheets

(56) References Cited

U.S. PATENT DOCUMENTS

| | | | | |
|---|---|---|---|---|
| 7,228,802 | B2 * | 6/2007 | Montefusco | F42B 8/16 102/501 |
| 7,731,557 | B2 * | 6/2010 | Nelson | A63H 27/001 446/36 |
| 7,874,947 | B1 * | 1/2011 | Wolfinbarger | A63H 33/18 473/578 |
| 8,012,049 | B1 * | 9/2011 | Walterscheid | F42B 6/08 473/572 |
| 8,348,789 | B1 * | 1/2013 | Walterscheid | F42B 6/08 473/578 |
| 8,366,572 | B1 * | 2/2013 | Joyce | A63B 65/02 473/578 |
| 2003/0027672 | A1 * | 2/2003 | Leal | A63B 43/00 473/613 |
| 2003/0045381 | A1 * | 3/2003 | Morris | F42B 6/06 473/578 |
| 2003/0100391 | A1 * | 5/2003 | Kessler | A63B 43/002 473/613 |
| 2009/0011870 | A1 * | 1/2009 | Neal | A63B 43/00 473/451 |
| 2014/0235380 | A1 * | 8/2014 | Martino | A63H 27/14 473/613 |
| 2014/0256479 | A1 * | 9/2014 | Bynum, Jr. | F42B 6/08 473/470 |
| 2016/0206931 | A1 * | 7/2016 | Martino | A63B 43/002 |

* cited by examiner

ELONGATED HAND THROWN PROJECTILE

FIELD OF THE INVENTION

The present invention relates to a throwing apparatus in recreational activities. In particular, the present invention relates to an elongated hand thrown projectile.

BACKGROUND OF THE INVENTION

The present invention relates to an elongated hand thrown projectile that can improve throwing mechanics and training for recreational activities. The invention can be used in any place that is large enough to throw an object from one person to another. The invention is simply manufactured and the elements of it can be detached for easy storage.

Overhead throwing is used in numerous recreational activities, including baseball, football, cricket, water polo, javelin throwing, and others. Although these are different activities, with different purposes, rules, and strategies, the mechanics of overhead throwing in each is quite similar; cross-training from one activity to another has its benefits. A pitcher can throw a javelin and use the mechanics for throwing the javelin to provide insight on how to better throw a baseball or other object. However, due to differences in the mechanics of javelin throwing and throwing for other objects—for instance in javelin throwing the throwers hand is supinated—the mechanics are not identical and thus cannot be directly applied from one to the other. From this "spear vs. sphere" dilemma, baseball throwers have had difficulty in throwing a javelin. To better transfer the skills from one sport to another, it is helpful to identify the discrete mechanics of a throwing motion, and determine which are beneficial and how they could be used within another sport.

The mechanics of baseball pitching are aimed at improving delivery, speed and accuracy of the ball. In recent years, some of those mechanics have become very controversial. Medical professionals and coaches have found that certain mechanics taught to pitchers, while beneficial in terms of speed and accuracy, are detrimental to parts of a pitcher's body, specifically his elbows and shoulders. Early wear-and-tear from throwing mechanics has led some young pitchers to undergo surgeries in hopes of extending their playing career. For older pitchers, such injuries have prematurely ended their career.

One of the main concerns now acknowledged by professionals in the industry is what is known as the "inverted W" which is the shape made by the arms of some pitchers, prior to pitching when in their prelaunch. For some, the inverted W comes naturally, and for others it is taught as a part of pitching mechanics. The problem with the inverted W is that following the prelaunch, and during the rapid firing of the ball, there is a "flopping" or "bouncing" of the arm when the throwing arm quickly moves from prelaunch to delivery, and the humerus bone rapidly changes direction. Many throwing coaches teach methods that lead to the inverted W simply because that is how they were taught. Some assume it provides for a greater range of motion (RoM), and others fail to see the correlation of their techniques as contributors to the "inverted W." However, due to injuries related to the inverted W, coaches and medical professionals have begun to urge pitchers to adjust their mechanics away from the inverted W.

The mechanics of the inverted W are typically as follows: 1) throwing arm abduction to an internal rotation of the rotator cuff, and pronation of the hand (showing the ball to second base); 2) external rotation and subscapular load flex of the rotator cuff as the elbow starts to accelerate forward (flopping or bouncing) and an effort to supinate the throwing hand to a neutral position; 3) internal rotation of the rotator cuff, triceps extension, and pronation of throwing hand during release. Experts are now exploring ways to teach beneficial pitching mechanics that continue to provide excellent pitching, but with an effort to avoid the inverted W or other mechanics that similarly strain a pitcher's arm and shoulder.

The problem that has arisen is that many experts disagree on what is the proper technique for pitchers, or if there is one proper technique to be taught at all, as opposed to player-specific techniques. However, what is becoming clear is, whatever the optimal positions and movements are, a simpler approach involving lesser arm movement is beneficial.

The present invention provides for a device aimed at teaching, or re-teaching, specific baseline mechanics that place the pitchers hand in a neutral rather than supinated or pronated position and which tracks the throwing motion on a linear path, thus away from the inverted W or similar methods. This position is the starting place for teaching pitchers how to throw without subjecting their arms to the wear-and-tear of over-rotational movements and techniques that are pre-cursors to the inverted W. The device provides for a neutral placement of a pitcher's hand that, in turn, further adapts the linear "spear throw" of a javelin to the linear "sphere throw" of a ball. This is accomplished by the specific arrangement of the elements of the device, determined through years of research, development and prototype testing. What has been discovered is that elongated throwing devices, like a javelin, are beneficial in training pitchers and in teaching them proper techniques that will track their arm motion on a linear, single-plane path, rather than a rounded, multi-plane path, thus reducing strain and injury. However, the technique used for throwing a javelin or similar device is not similar enough to baseball throwing oriented movements, creating the "spear vs. sphere" dilemma, and thus a new apparatus is necessary.

From this new device and the training associated with it, pitchers and coaches can alter techniques that will place the pitcher's hand in a neutral position, and that will prevent the excessive movement seen in other techniques. Many pitchers have years of muscle memory that needs replacing. This device can quickly teach pitchers how their technique should be altered, and will force their body into the proper position. Thus, rather than simply being told what to do, the device shows pitchers what to do by overcoming previous muscle memory and finite neuro-pathways, abandoning undesired movements, and creating new neuro-pathways.

The present invention addresses these and other deficiencies related to throwing mechanics by providing an apparatus arranged to place the hand in a neutral position and to mimic the throw required by a javelin, or "spear," with the grip and optimal position of a ball, or "sphere."

BRIEF DESCRIPTION OF THE FIGURES

Advantages of the invention will become apparent upon reading the following detailed description and upon reference to the drawings.

DETAILED DESCRIPTION

Figure 1:
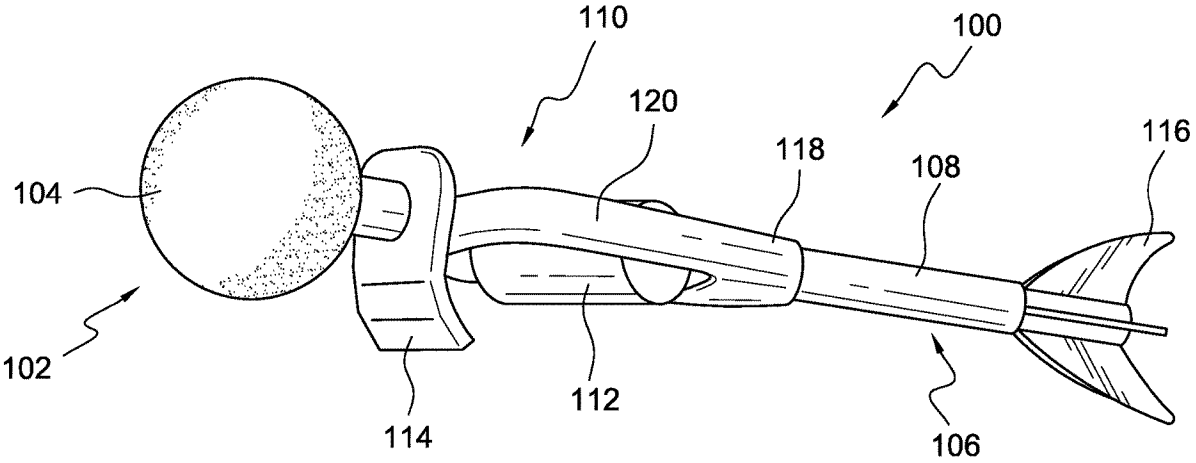
FIG. 1 is a perspective view according to one embodiment of the present invention.

Throughout this application, the directional references, such as forward, rearward, left, right, bottom and top, will be used. Such references are used for ease in describing the present invention and should not be construed as limiting the scope of the invention. As used in the description herein and throughout the claims, the following terms take the meanings explicitly associated herein, unless the context clearly dictates otherwise: the meaning of "a," "an," and "the" includes plural reference, the meaning of "in" includes "in" and "on." Also, reference designators shown herein in parenthesis indicate components shown in a figure other than the one being discussed.

The present invention addresses the need for teaching mechanics of pitching in baseball. The invention provides for an elongated hand thrown projectile that places a pitcher's hand in a neutral position and requires the pitcher the throw in a linear, single-plane tracking motion. FIGS. 1-4 show an exemplary embodiment of the invention, an elongated hand thrown projectile 100 that is used to teach pitchers proper mechanics according to neutral-hand throwing position. The projectile body 100 has a projectile axis $A_1$, a forward end 102 having a spheroidal head 104, a rearward end 106 having a shaft 108, a midsection 110 arranged between and connected to the forward end and the rearward end, a finger grip 112 attached to the projectile body having a longitudinal grip axis $A_2$ extending perpendicular to the projectile axis, and a thumb grip 114 attached to the projectile body between the spheroidal head and the finger grip. The finger grip has a length L that is substantially less than the length of the projectile. The thumb grip has a planar portion and is in close proximity to the finger grip such that each can be simultaneously gripped by the thumb and finger of a single hand. For the embodiments of FIGS. 1-4, the head of the forward end is spheroidal, and the tail or shaft of the rearward end is cylindrical. It will be understood by those with skill in the art that the head need not be spheroidal and the shaft need not be cylindrical to implement the claimed invention.

The projectile body rearward end 106 of the embodiment of FIG. 1 includes fletching 116 to provide for better flight of the projectile. It will be understood that fletching is used to assist in the flight of the projectile but is not required by the present invention.

The finger grip of the embodiment of FIGS. 1-4 is cylindrical, however it will be understood that an oval grip or polygonal grip could also be provided.

Figure 2:
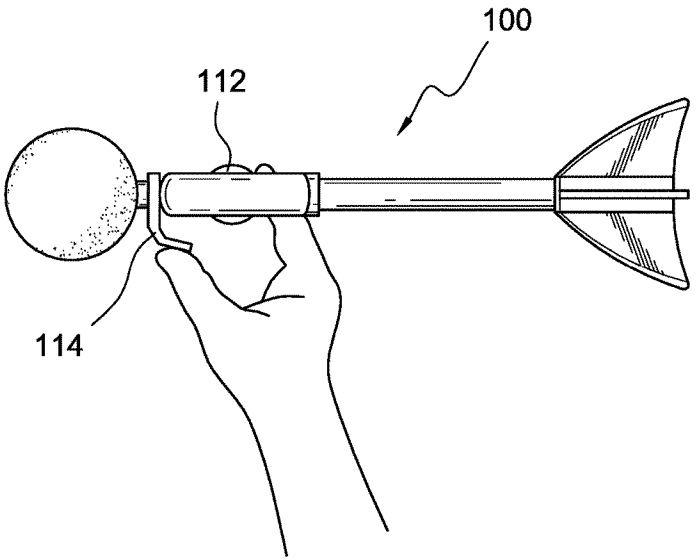
FIG. 2 is a side view of a person's hand holding the embodiment of FIG. 1.

As shown in FIG. 2, a pitcher engages with the finger grip and thumb grip by gripping both with his pitching hand. The pitcher reaches the projectile behind his head, with his hand in a neutral position, thrusts his hand forward and releases the projectile by pushing off with his fingers on the finger grip 112 and releasing his thumb from the thumb grip 114. The finger grip 112 and thumb grip 114 are formed and arranged to substantially replicate the shape of a baseball or similar object at the location of the pitcher's fingers and thumb. Notably, the finger grip 112 may be rotatable to enhance the sensation of a "finger roll" felt on a ball when throwing it. The finger grip may further be rotatable in a single direction, via a one-way bearing or similar device, and may include a clutch or lock that stops the finger grip from rotating.

The spheroidal head 102 and cylindrical shaft 108 of the embodiment of FIGS. 1-4 provides for the flight and catchability of the device, the head being similar to a baseball and the shaft similar to a javelin. The shaft and its elongated configuration requires that the device be thrown in a mostly linear, single-plane motion, like that of a javelin, otherwise it is unlikely to fly correctly, and is prone to hit the player in the back of the head. The device forces the thrower to position his or her hand in a neutral position, perpendicular to the projectile axis $A_1$, opposed to in a supinated or pronated position.

Figure 4:
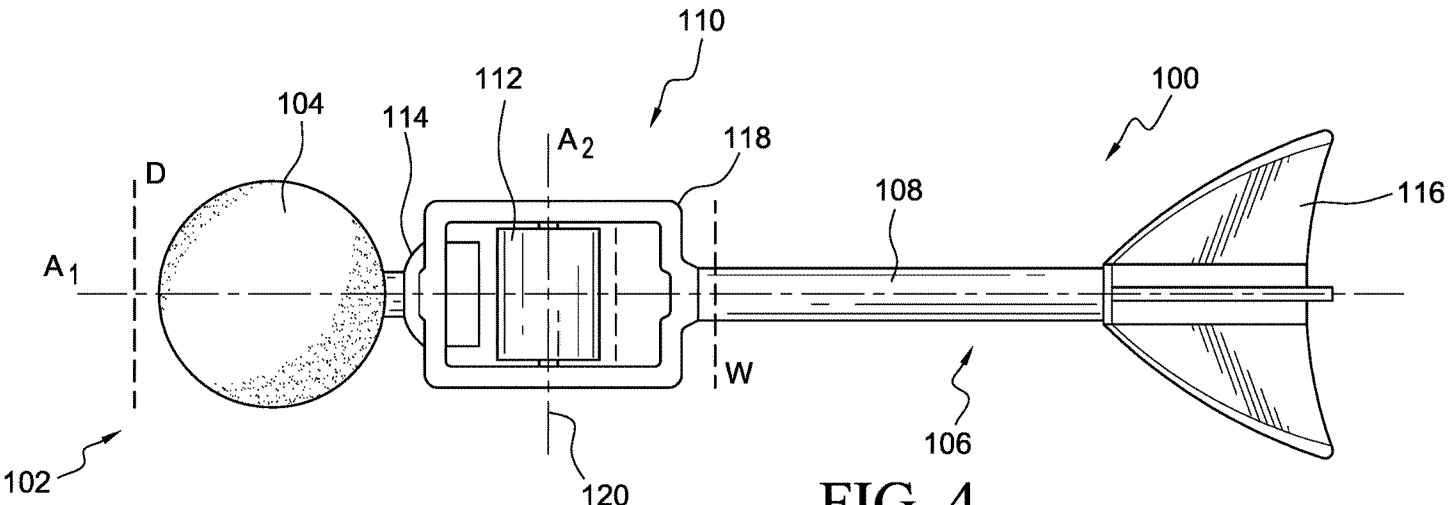
FIG. 4 is a top view of the embodiment of FIG. 3.

FIGS. 1 and 4 show a perspective and top view of an exemplary embodiment of the elongate projectile. In this embodiment, the finger grip 112 is positioned between the side walls 120 of a frame 118. The outer edges of the side walls are separated by a distance W no greater than the diameter D of the spheroidal head 102.

In other embodiments, the frame can be circular, triangular, octagonal or another similar shape. Further, a portion of the device, the head, midsection, or shaft, could be offset above or below the other portions.

In yet another embodiment, there is no frame, but rather, the spheroidal head 102 and shaft 104 are directly connected, and the finger grip 112 and thumb grip 114 are connected to the shaft. The finger grip could be connected to the shaft by any available method, for instance by using a clamp, collar or other device.

Figure 3:
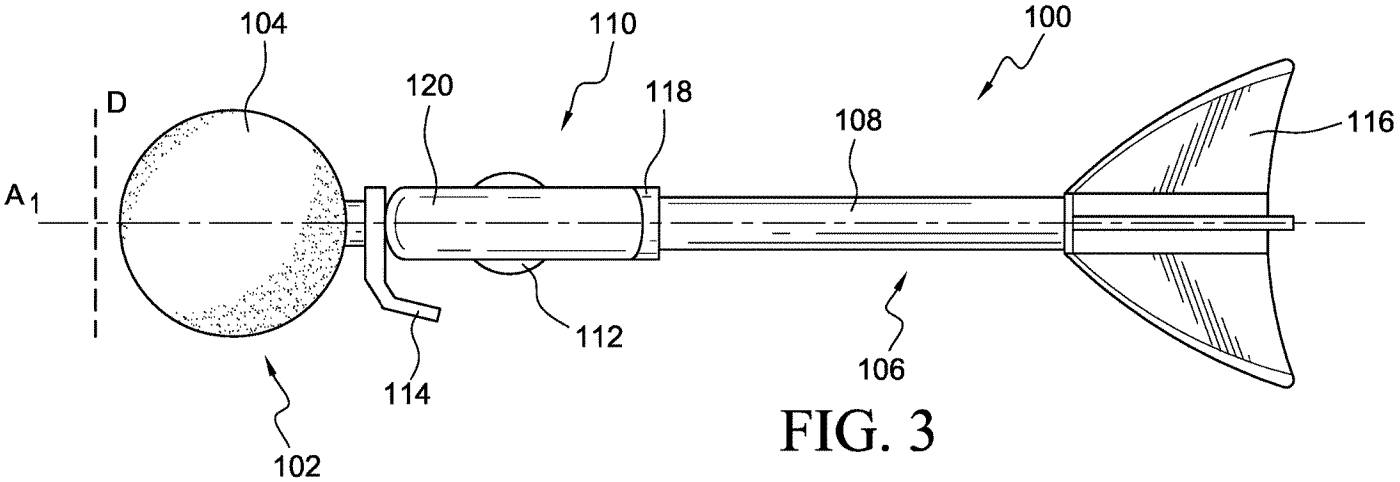
FIG. 3 is a side view according to one embodiment of the present invention.

FIGS. 1 and 3 show a perspective view and side view of an exemplary embodiment of the elongated projectile. The thumb grip 114 is positioned between the spheroidal head 102 and the finger grip 112 and has a planar portion. The thumb grip is curved at its distal end to provide for the curvature of a thumb when gripping the plate, and to allow for different thumb positions. The thumb grip connects to the spheroidal head 102 and the frame 118.

In an alternative embodiment, the thumb grip 114 is arranged within a recess of the spheroidal head. In this embodiment, the thumb grip is not connected to the spheroidal head 102 and shaft 104. The thumb grip positioned within the spheroidal head is of a similar configuration to that of the thumb grip 114 of FIGS. 1-4.

In another embodiment, a second shaft is arranged between the spheroidal head and the midsection, lengthening the projectile and adjusting the balance of the device.

Figure 5:
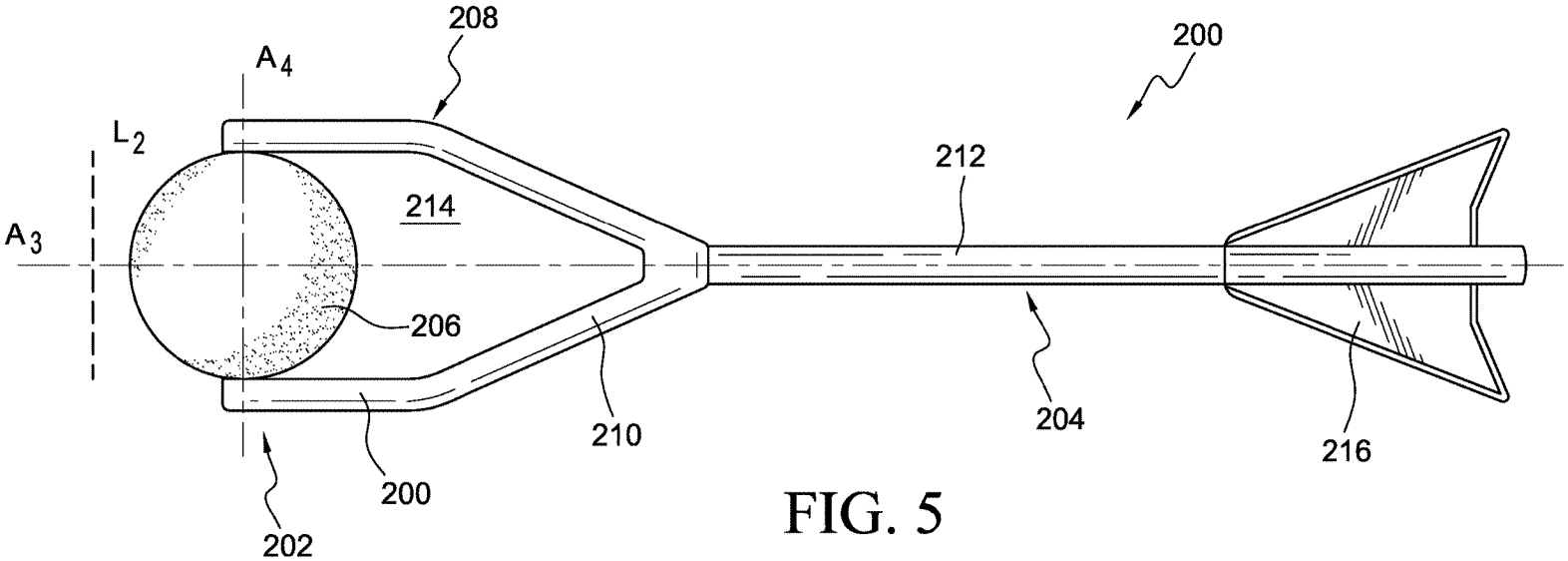
FIG. 5 is a top view according to an alternate embodiment of the present invention.
Figure 6:
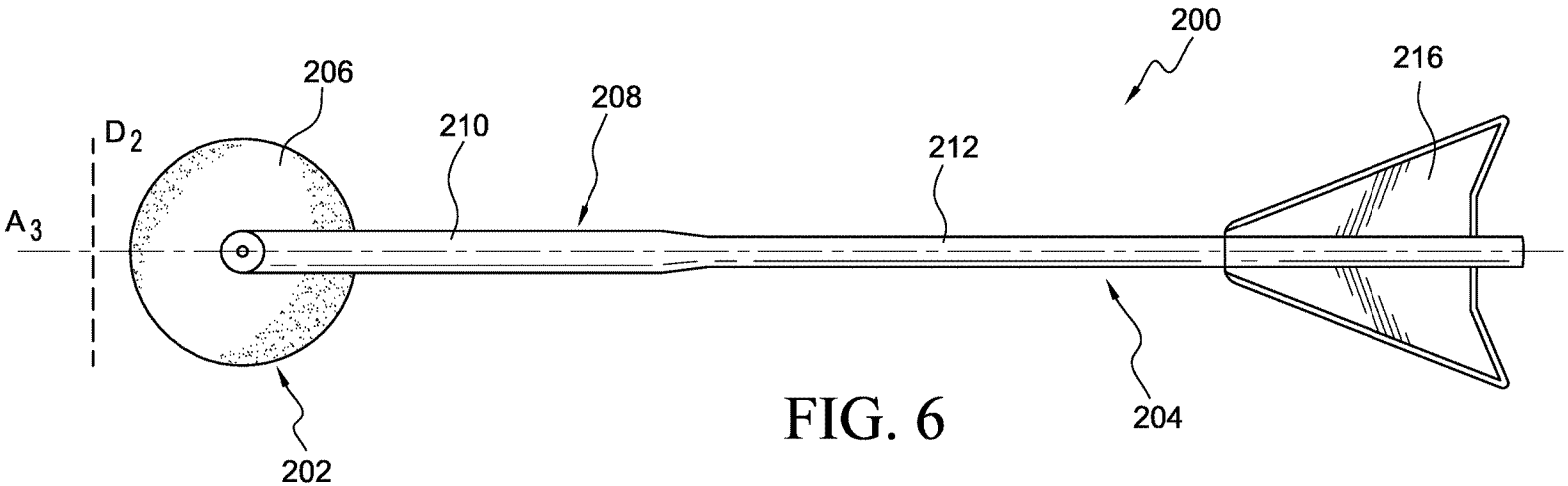
FIG. 6 is a side view of the embodiment of FIG. 5.

FIGS. 5 and 6 show an alternate embodiment of the present invention. An elongated hand thrown projectile 200 has a forward end 202 and a rearward end 204 with a projectile axis $A_3$ extending between the forward end and the rearward end. The projectile body forward end comprises a generally spheroidal finger grip 206 attached to the forward end of the projectile body. The finger grip has a longitudinal grip axis $A_4$ extending perpendicular to the projectile axis and through the finger grip 206. The length $L_2$ of the finger grip is parallel to the grip axis and is substantially the diameter of the spheroidal finger grip 206. A support frame 208 is connected to the finger grip 206 at the longitudinal finger grip axis $A_4$. The support frame includes sidewalls 210 which extend parallel to the projectile axis A3 from the finger grip axis toward the rearward end 204 of the projectile body and define an opening 214. The support frame attaches to the projectile body rearward end 204, which comprises an elongated shaft 212. Fletching 216 is attached to the elongated shaft.

The spheroidal finger grip diameter $D_2$ is such that the thumb and finger of a single hand can simultaneously grip opposite sides of the finger grip.

The embodiment of FIGS. 5 and 6 is used in similar way as the embodiment of FIGS. 1-4 as shown in FIG. 2. A person grips the spheroidal finger grip 206 with his fingers and thumb, and then reaches the projectile behind his head. With his hand in a neutral position, he thrusts his hand forward and releases the projectile by pushing off with his fingers on the finger grip and releasing his thumb with a snap of the wrist. The finger grip 206 formed and arranged to substantially replicate the shape of a baseball or similar object at the location of the pitcher's fingers and thumb. However, the finger grip of the present embodiment is rotatable about its longitudinal grip axis $A_4$ to enhance the sensation of a "finger roll" felt on a ball when throwing it. It is contemplated by the present embodiment to have a finger grip that is rotatable in a single direction, via a one-way bearing or similar device, to allow for stability with the device prior to releasing it during a throwing motion.

Further embodiments of the present invention are contemplated as follows. In one, the finger grip is partly housed within the rearward end of the spheroidal head 104 and/or the spheroidal finger grip 206. In this embodiment, the projectile axis is positioned within the rearward portion of the spheroidal head, and the finger grip is exposed to be gripped by fingers. The thumb then grips the portion of the spheroidal head that is opposite the finger grip and the projectile is thrown similarly to those detailed above.

Another embodiment includes a plurality of grooves running from the front end of the spheroidal head/finger grip to the back end of the head/finger grip to provide for better aerodynamics during flight. In another, the spheroidal head and/or spheroidal finger grip is hollow to reduce its mass and to provide for a more balanced device. In the embodiment of a hollow spheroidal head and/or spheroidal finger grip, beans, beads, or other similar object can be placed within the hollow body to assist in hearing unwanted movements during a pitching motion.

In another embodiment of the present invention, the forward end of the device includes a light to make the device visible in low-lit areas or at night. The light can be integral with the device or may be detachable or removable for use only when needed.

Further, other embodiments include a computer such as a smart electronic devices or other similar devices arranged within or attached to the hand thrown projectile. In different embodiments, the computer can provide a range of technologies, such as, Bluetooth connectivity for use with other computers and applications, a wireless network connection, a microphone and camera, a video screen, audio speakers and amplifier, a Global Positioning System (GPS), a speedometer, or other similar technologies for tracking the movement of the device, taking video while using the device, or connecting a personal computer to the device.

While the present invention has been described with reference to one or more particular embodiments, those skilled in the art will recognize that many changes may be made thereto without departing from the spirit and scope of the present invention. Furthermore, components from one embodiment can be used in other non-exclusive embodiments. Each of these embodiments and obvious variations thereof is contemplated as falling within the spirit and scope of the invention.

I claim:

1. An elongated hand thrown projectile, comprising:

a projectile body having a rounded head at its forward end, a midsection comprising a support frame having opposing coplanar side walls defining a through pening therebetween, and a shaft at a rearward end, the midsection having a width substantially the diameter of the rounded head, wherein a projectile axis extends between the rounded head and the shaft;

a finger grip attached to the projectile body, the finger grip having a longitudinal grip axis extending perpendicular to the projectile axis, the finger grip having a length parallel to the grip axis that is substantially less than a length of the projectile; and a thumb grip;

wherein: the thumb grip is attached to the projectile body at a position longitudinally forward of the finger grip.

2. The elongated hand thrown projectile of claim 1, wherein the finger grip is generally cylindrical.

3. The elongated hand thrown projectile of claim 1, wherein the finger grip is polygonal.

4. The elongated hand thrown projectile of claim 1, wherein the finger grip is generally oval.

5. The elongated hand thrown projectile of claim 1, wherein the finger grip is rotatable about its longitudinal grip axis.

6. The elongated hand thrown projectile of claim 5, wherein the direction of rotation is such that the finger grip is rotating upward relative to the projectile body at a forward portion of the grip.

7. The elongated hand thrown projectile of claim 1, wherein the thumb grip comprises a planar portion that extends perpendicularly to the projectile axis.

8. The elongated hand thrown projectile of claim 1, wherein the thumb grip further comprises a non-planar portion.

9. The elongated hand thrown projectile of claim 1, wherein the rounded head has a spheroidal configuration.

10. The elongated hand thrown projectile of claim 1, wherein the finger grip is positioned between the support frame sidewalls.

11. The elongated hand thrown projectile of claim 1, wherein the finger grip is attached to the support frame.

12. The elongated hand thrown projectile of claim 1, wherein the rounded head and shaft are detachable.

13. The elongated hand thrown projectile of claim 1, wherein the rounded head, shaft, and support frame are detachable.

14. The elongated hand thrown projectile of claim 1, wherein the shaft comprises a telescoping shaft.

15. The elongated hand thrown projectile of claim 1, wherein the projectile body further comprises a shaft positioned longitudinally between the rounded head and the thumb grip.

* * * * *